US005284445A

United States Patent [19]

Dietterich et al.

[11] Patent Number: 5,284,445

[45] Date of Patent: Feb. 8, 1994

[54] PORTABLE DRAWING SURFACE WITH INTERCHANGEABLE COMPONENTS

[75] Inventors: Charles W. Dietterich, Brodheadsville, Pa.; Richard A. Tarozzi, Gales Ferry, Conn.

[73] Assignee: Binney & Smith Inc., Easton, Pa.

[21] Appl. No.: 670

[22] Filed: Jan. 5, 1993

Related U.S. Application Data

[63] Continuation-in-part of Ser. No. 948,811, Sep. 17, 1992.

[51] Int. Cl.[5] ..... B43L 1/00

[52] U.S. Cl. ..... 434/419; 434/415; 434/413; 434/408; 434/85

[58] Field of Search ..... 434/85, 88, 192, 408, 434/409, 413, 414, 415, 418, 419, 432

[56] References Cited

U.S. PATENT DOCUMENTS

| | | | |
|---|---|---|---|
| D. 38,127 | 7/1906 | Whiting | D19/52 |
| D. 194,517 | 2/1963 | Banks | D19/52 |
| D. 196,974 | 11/1963 | Korbos | D19/52 |
| D. 233,486 | 10/1974 | Gonzalez | D7/553 X |
| D. 236,556 | 8/1975 | Di Paola et al. | D3/74 |
| D. 250,437 | 12/1978 | Korpijaakko et al. | D6/420 X |
| D. 251,213 | 2/1979 | Rodin et al. | D3/74 |
| D. 255,251 | 6/1980 | Hansen et al. | D19/88 |
| D. 261,903 | 11/1981 | Mulder | D19/88 |
| D. 270,739 | 9/1983 | Pearson | D19/86 X |
| D. 270,740 | 9/1983 | Pearson | D19/86 X |
| D. 282,792 | 3/1986 | Zinbarg | D6/406 |
| D. 293,739 | 1/1988 | Nadeau | D3/74 XR |
| D. 293,740 | 1/1988 | Nadeau | D3/74 X |
| D. 313,819 | 1/1991 | Craft, Jr. et al. | D19/86 X |
| D. 317,017 | 5/1991 | Kheng | D19/86 X |
| D. 317,446 | 6/1991 | Vossoughi et al. | D19/52 X |
| D. 318,481 | 7/1991 | Milne | D19/92 X |
| 173,269 | 2/1876 | Chinnock | 434/408 |
| 193,464 | 7/1877 | Shepherd | 434/413 X |
| 1,559,665 | 11/1925 | Beery et al. | 434/88 |
| 2,257,005 | 9/1941 | Grosse | 434/88 X |
| 3,562,929 | 7/1968 | Elmore, Jr. | 434/434 |
| 3,768,177 | 10/1973 | Thomas | 434/192 X |
| 4,340,372 | 7/1982 | Brassine | 434/415 X |
| 4,817,935 | 4/1989 | Varga . | |
| 4,912,849 | 4/1990 | MacCarthy | 434/88 X |
| 5,163,845 | 11/1992 | Blassingame | 434/413 X |
| 5,163,846 | 11/1992 | Lee | 434/408 |

OTHER PUBLICATIONS

Gift and Tableware Reporter, Sep. 7,1 964, p. 25 see "Clip Caddy" with drawer, lower left.

Color photocopy of photograph of Binney & Smith Inc., Coloring Tote.

Binney & Smith Inc., color photocopy from Crayola Consumer Products catalogue of Crayola Draw-N-Do Desk.

Rose Art Industries, Inc., Directions for "Teenage Mutant Ninja Turtles Light Art".

Five photographs of Rose Art Industries, Inc., "Teenage Mutant Ninja Turtles Light Art" toy.

Binney & Smith Inc. color photocopy from Crayola Consumer Products catalogue of Crayola Sketch--N-Go.

*Primary Examiner*—Gene Mancene
*Assistant Examiner*—L. Thomas
*Attorney, Agent, or Firm*—Leydig, Voit & Mayer Ltd.

[57] ABSTRACT

This invention relates generally to portable drawing surfaces and more particularly to a base structure with interchangeable components. The invention permits the manufacture of a base structure that can be combined with an accessory unit and a working surface to create either a lighted drawing surface or a drawing surface with a utensil accessory tray. This results in substantial savings in manufacturing costs as tooling requirements are substantially lowered. The lighted drawing surface includes a working surface, a lighting accessory unit and a base structure to provide a backlit surface for tracing and drawing. The portable drawing surface replaces the lighting accessory unit with a utensil accessory unit and thereby provides a drawing surface with a tray for displaying and organizing utensils.

40 Claims, 9 Drawing Sheets

PORTABLE DRAWING SURFACE WITH INTERCHANGEABLE COMPONENTS

RELATED APPLICATIONS

This application is a continuation-in-part of a pending application of Richard A. Tarozzi, U.S. Ser. No. 07/948,811 filed on Sep. 17, 1992.

BACKGROUND OF THE INVENTION

This invention relates generally to portable drawing surfaces and more particularly to a base structure with interchangeable components. The invention permits the manufacture of a base structure that can be combined with an accessory unit and a working surface to create either a lighted drawing surface or a drawing surface with a utensil accessory tray. Without this invention, it would be necessary to manufacture separate base structures to create drawing surfaces of different characteristics. For example, one manufacturing line would be needed for molding base structures for a drawing surface with a utensil accessory tray. An entirely separate line with another set of manufacturing equipment and operating personnel would be needed to mold base structures for a lighted drawing surface. Thus, a great deal of wasteful duplication in machinery and personnel would be necessary to make two distinct drawing surfaces.

This invention obviates the need for such duplicative efforts. The interchangeable nature of the base structure and other components enables the manufacture of multiple drawing surfaces with distinctive characteristics from the same base parts. This invention greatly reduces molding costs since molds for only one base structure, not two, are needed. This invention results in substantial savings in manufacturing costs as tooling requirements are substantially lowered. Thus, this invention permits the economical manufacture of portable drawing surfaces with either an accessory tray for storing drawing utensils or a backlit working surface.

SUMMARY OF THE INVENTION

This invention has evolved with the general object of providing an improved portable drawing surface at reduced manufacturing cost.

The present invention provides an improved portable drawing surface by utilizing a backlit working surface whose lighting chamber functions additionally as storage for drawing utensils. Thus, the device provides a lightweight surface that can easily be transported and used in a variety of settings. The drawing surface has a dual function as a carrying case which makes the transportation of any drawing utensils needed for use with the drawing surface an easy task. Moreover, the invention is provided with a light bulb and a battery compartment that function to create a backlit working surface to facilitate tracing of drawings and patterns. Consequently, the invention provides a flexible, portable drawing surface that can be taken almost anywhere.

In accordance with an important aspect of this invention, the base structure of the invention is manufactured to accept interchangeable accessories. The base structure can accept a working surface and either: (1) a lighting accessory unit comprising a battery compartment, a connected light source, and corresponding circuitry for powering the light source; or (2) a drawing utensil accessory tray. Thus, the base structure of this invention can be used to manufacture at least two distinctive drawing surfaces with correspondingly distinct characteristics without the need for tooling separate molds for the base structure. This results in substantial savings in the manufacturing and sale of portable drawing surfaces as the tooling costs of manufacturing are greatly reduced. It also reduces manufacturing costs by obviating the need for separate manufacturing lines for distinct base structures.

This invention contemplates other objects, features and advantages which will become more fully apparent from the following detailed description taken in conjunction with the accompanying drawings.

BRIEF DESCRIPTION OF THE DRAWINGS

For a more complete understanding of this invention, reference should now be had to the embodiments illustrated in greater detail in the accompanying drawings and described below by way of an example of the invention.

In the drawings.

DESCRIPTION OF A PREFERRED EMBODIMENT

Figure 1:
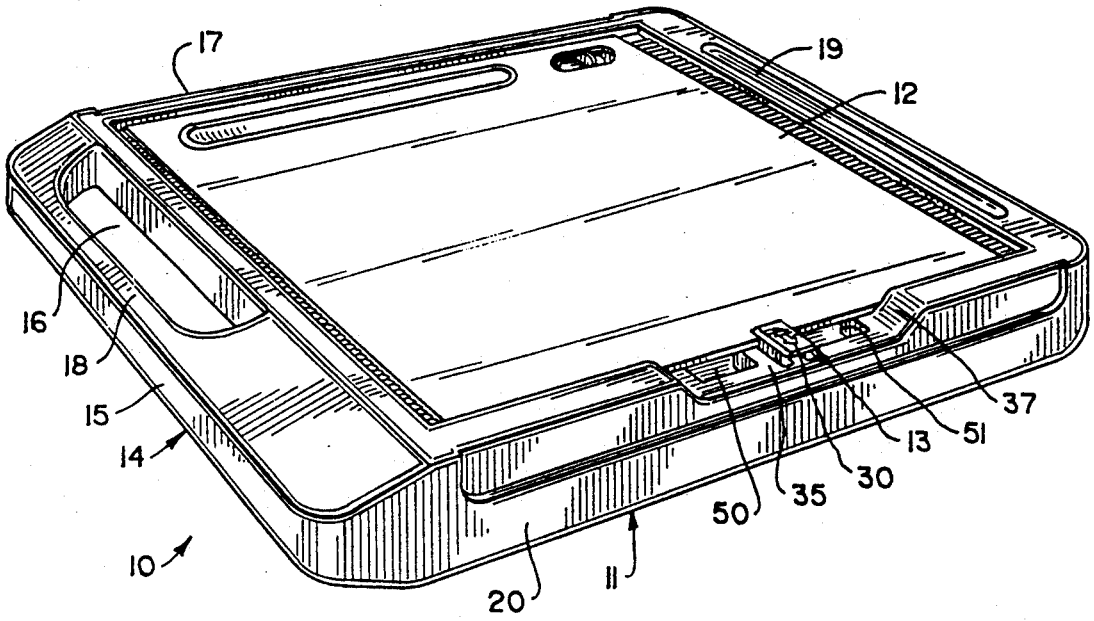
FIG. 1 is a left front perspective view of the lighted drawing surface.
Figure 2:
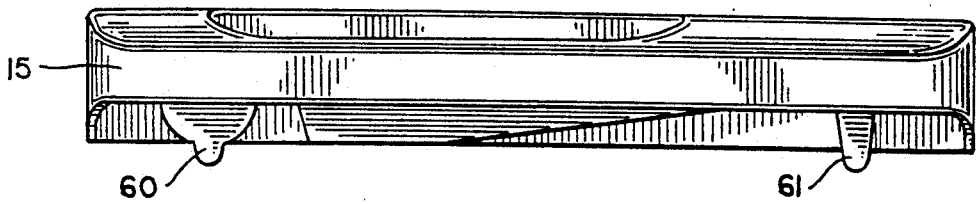
FIG. 2 is a left side elevational view of the invention in FIG. 1 illustrating the handle design and leg supports of the carrying case.
Figure 3:
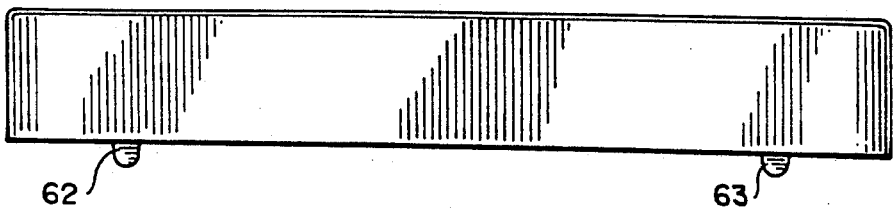
FIG. 3 is a right side elevational view of the invention in FIG. 1.

Reference numeral 10 in FIG. 1 refers generally to a lighted portable drawing surface comprising a base structure 11, a working surface 12 and a latch assembly 13. The base structure 11 is constructed from molded plastic. The working surface 12 is also constructed of molded plastic and is held snugly against the base structure 11 by the latch assembly 13.

The base structure 11 is molded with various recesses and ridges that serve various functions. For instance, on the left side of the working surface 12 in FIG. 1, the base structure 11 is molded to form a handle 14. The handle 14 slants at a downward angle from the working surface 12 such that it is narrowest in thickness at the edge 15 farthest from the working surface. The handle contains a trapezoidal or D-shaped opening 16. This opening 16 is located near the back edge 17 of the base structure 11. The opening 16 and the narrowing angle of the handle 14 combine to create an easily gripped handpiece 18 for carrying the light box.

As seen in FIG. 1, the base structure 11 also has a utensil trough 19 formed on the right side of the working surface 12. This utensil trough 19 is rounded such that it resembles a half cylinder. It runs nearly the entire length of the working surface 12 and is ideal for holding drawing utensils such as pens, pencils and crayons.

Figure 4:
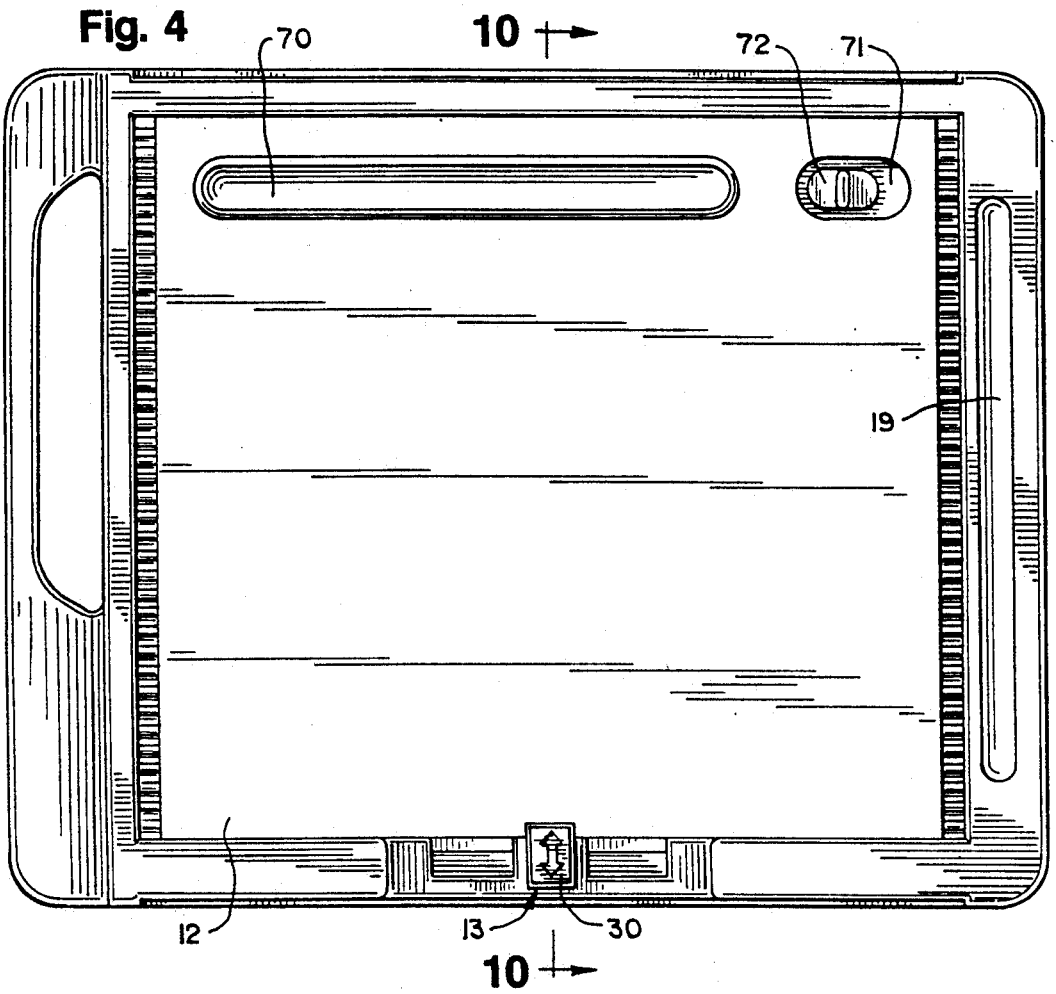
FIG. 4 is a top plan view of the invention showing the handle, working surface and light switch among other features of the invention.
Figure 5:
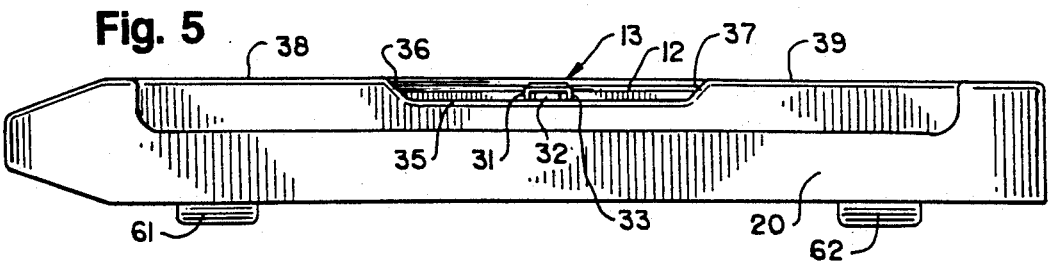
FIG. 5 is a front elevational view of the invention in FIG. 1 illustrating the latch assembly.
Figure 6:
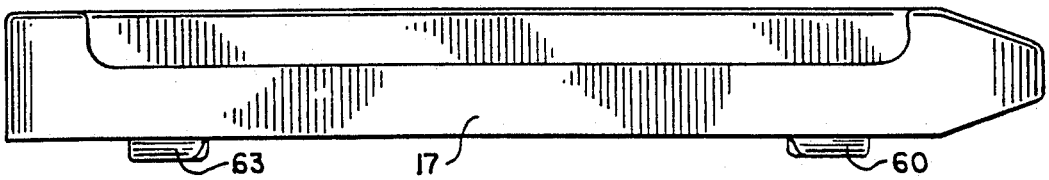
FIG. 6 is a rear elevational view of the invention in FIG. 1.

As seen in FIGS. 4 and 5, the locking assembly 13 comprises a plastic rectangular button 30 that is positioned in a plane slightly above but parallel to the working surface 12. The rectangular button 30 is supported by four support legs 31, 32, 33 and 34. These support legs 31, 32, 33 and 34 can be seen in FIG. 5 and FIG. 10 of the drawings.

Figure 7:
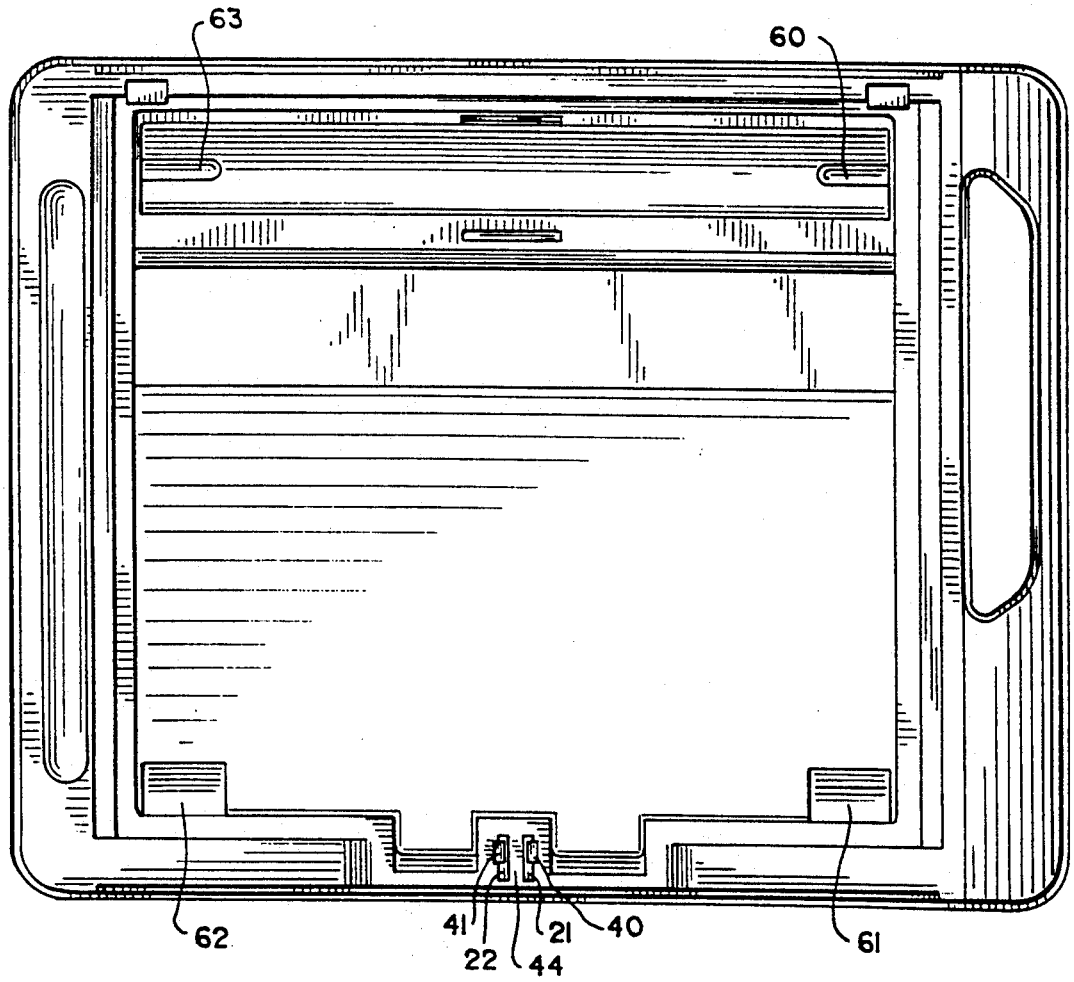
FIG. 7 is a bottom plan view of the invention.
Figure 10:
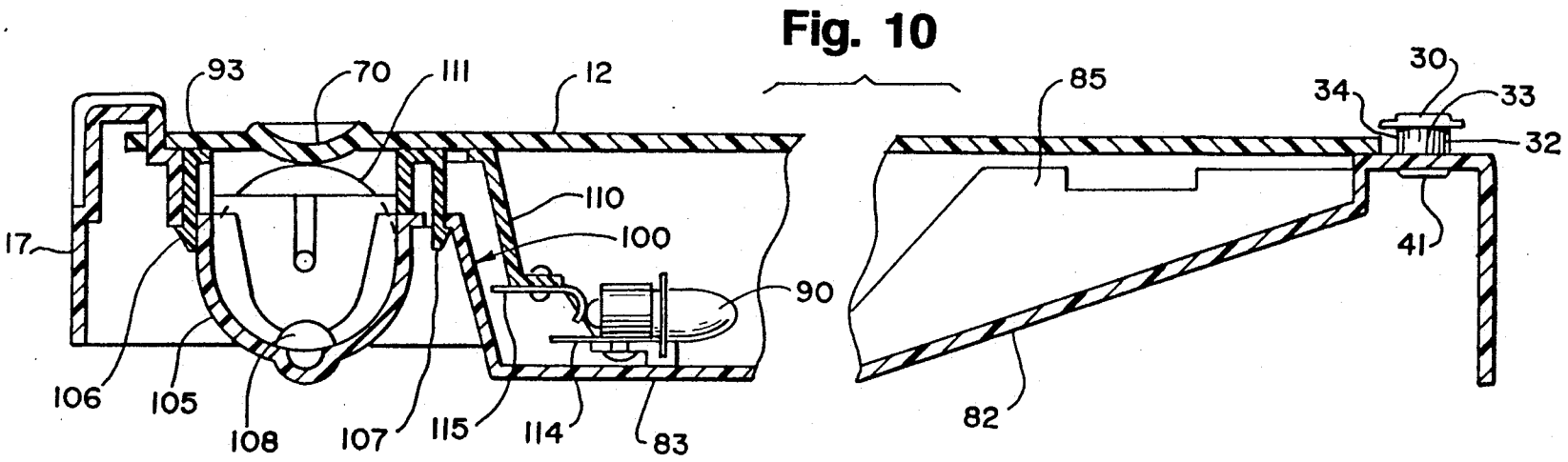
FIG. 10 is a dissected cross-sectional view taken along lines 10—10 of FIG. 4 which shows the lighting accessory positioned in the base structure and the latch assembly.

Referring again to FIG. 1, the foremost edge 20 of the base structure 11 provides a functional environment for the locking assembly 13. As seen in FIG. 5, the foremost edge 20 provides an upper edge surface 35 that is slightly lower than the working surface 12 to support the locking assembly 13. This slightly lower edge surface 35 is connected to the higher edge surfaces 38 and 39 by ramps 36 and 37. Moreover, as best seen in FIG. 7, the base structure 11 contains two paired grooves 21, 22 that receive the longest leg supports 31, 33 of the rectangular button 30. These leg supports 31, 33 have end tabs 40, 41 respectively which slightly overlap the underside of the base structure 11 and, consequently, keep rectangular button 30 from inadvertently detaching. Moreover, as shown in FIGS. 5 and 10, the leg supports 32 and 34 of the button 30, rest on the top surface of the lower edge surface 35 located between the paired grooves 21, 22. This combination of leg supports serves to keep the rectangular button 30 positioned in a parallel plane slightly above the working surface 12.

In operation, the button 30 is slid back and forth in the grooves 21, 22 to either lock the working surface 12 in place or allow it to be raised as desired. Starting from the locked position, when the user wants to raise the working surface 12, he would slide the button 30 forward away from the working surface 12. Support legs 31 and 33 would then slide to their forwardmost position in grooves 21 and 22 respectively. At this point, the working surface 12 will be able to freely pass upwards without any hindrance from the button 30 of the locking assembly 13. Then, after the working surface 12 is lowered, the working surface 12 can be secured in the closed position by sliding the button 30 rearward toward the working surface 12. In its rearward position, button 30 will overlap the working surface 12 and interfere with its upward movement. As can be seen in FIG. 4, the button 30 overlaps the working surface 12 in a snug manner when slid into the lock position and thereby holds the surface closed during transportation and use.

Referring again to FIG. 1, the base structure 11 can be seen to have two recesses 50, 51 in the upper surface 35. These recesses 50, 51 form finger holes for lifting the working surface 12 from the closed position.

As seen in FIGS. 2, 3, 5, 6 and 7, the base structure has four legs 60, 61, 62 and 63. These legs are molded out of the base structure 11. Consequently, they form recesses inside the base structure 11 and corresponding protrusions that act as legs 60, 61, 62 and 63 on the underside of the base structure as seen in FIG. 7.

As illustrated in FIG. 4, the working surface 12 has several unique features. The working surface 12 has a semi-cylindrical utensil trough 70 for holding drawing instruments such as pens, pencils or crayons. This trough 70 is functionally identical to trough 19 discussed above. The working surface 12 is also constructed with an oval hole 71 that receives a light switch 72. Thus, the working surface 12 allows the operation of the lighted drawing surface 10 by providing access to the light switch 72.

As already mentioned, the working surface 12 is held in its locked position by locking assembly 13. At the opposite end, the working surface 12 is connected to base structure 11 by means of a tab and slot hinge. As seen in FIG. 9, base structure 11 is constructed with two rectangular slots 75, 76 in its back wall. These rectangular slots 75, 76 receive the tabs 77, 78 of the working surface to form a hinge-like connection. When the working surface 12 is raised, the tabs 77, 78 swing down in the slots 75, 76. When the working surface 12 is lowered, the tabs 77, 78 swing back up to their level position. The interaction between the tabs and the slots operates like a hinge. While these tabs 77, 78 do not prevent the removal of the working surface 12, they do provide a semi-fixed restraint on its movement that allows the working surface 12 to be lifted without being detached from the base structure 11. This hinge-like connection can be seen in FIG. 8 of the drawings.

Figure 8:
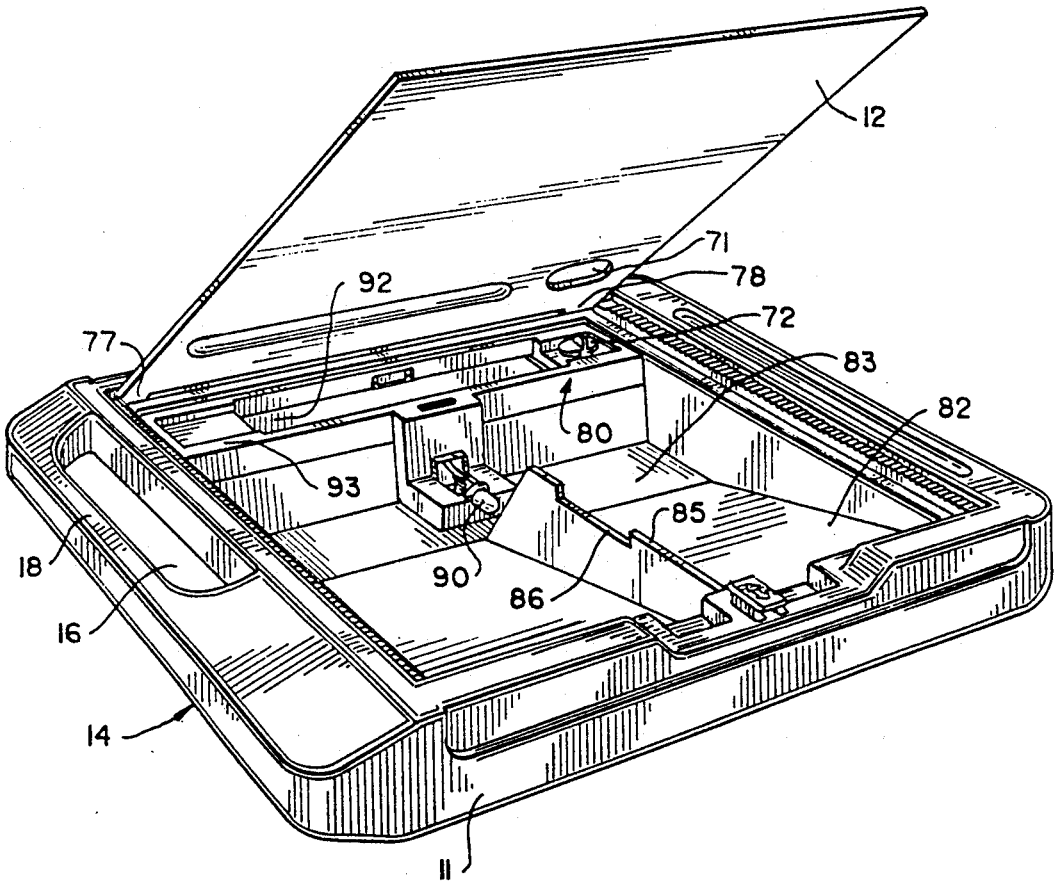
FIG. 8 is a right front perspective view of the invention with its working surface in a raised position illustrating the internal construction.
Figure 9:
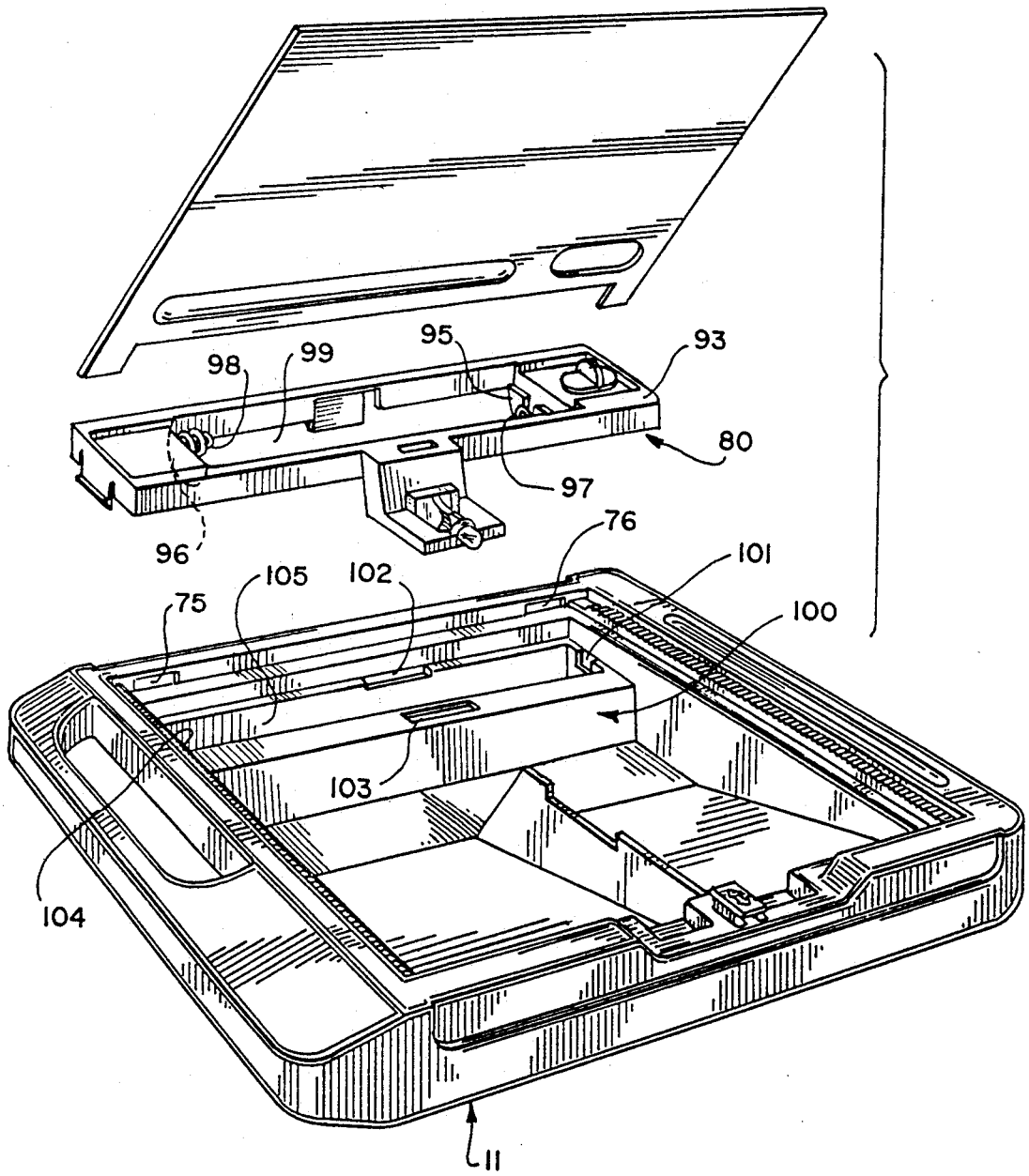
FIG. 9 is a left front perspective exploded view of the invention.

Besides illustrating this hinge-like behavior, FIG. 8 depicts another important aspect of this invention. In that figure, the working surface 12 is in a raised position. Thus, the interior of the base structure 11 is revealed. This interior serves as a storage area for drawing utensils. It also contains the lighting accessory unit 80 for illuminating the working surface.

The interior of the base structure 11 consists of a sloping floor 82 and a flat floor 83. The sloping floor 82 runs downward from the latch assembly 13 to the flat floor 83 and is separated into two portions by a support wall 85. This wall 85 supports the center of the working surface 12 during use and thereby prevents breakage or undue curvature of the surface. The support wall 85 has a notched section 86 that allows some bending of the working surface 12. Thus, the notched wall support 85 serves to minimize the stress on the working surface 12.

The downward sloping floor 82 is positioned at an angle to the light bulb 90. Consequently, much of the floor's surface is exposed to the light source. As a result, more light is reflected upwards due to reflection of the light from the sloped floor 82 than would be from a flat floor. Thus, the sloping floor 82 results in a more evenly lit working surface 12.

The internal construction of the lighted carrying case is such that its heaviest parts, namely, the accessory units, are located at the back of the structure. As previously mentioned, handle 14 has a opening 16 that forms a handpiece 18 for easy carrying of the lighted drawing surface. This opening 16 is located at the rear section of the handle 14. The handpiece is placed in this rearward position to accommodate the heavy accessory units that will be contained at the rear of the body. The carrier's grip will thus be directly over the heaviest part of the lighted drawing surface. This will place the grip closer to the lighted drawing surface's center of gravity than would a more centered grip. Consequently, this design greatly eases transportation.

In accordance with a further aspect of this invention, FIG. 8 illustrates the placement of the lighting accessory unit 80 in the base structure 11. The lighting accessory unit 80 comprises a light bulb 90, the light switch 72 and a support structure 93. The support structure 93 includes a battery opening 92 which will accommodate three D cell batteries. As seen in FIG. 9, the base structure 11, provides a recessed platform 100 with a semi-cylindrical recess 105 that supports the lighting accessory unit 80. This recessed platform 100 is constructed with four notches 101, 102, 103, 104. These notches 101, 102, 103, 104 are located in the center of each wall of the recessed platform 100. Thus, they are ideally situated to receive tab supports for the lighting accessory unit 80.

Referring to the dissected cross-sectional view of FIG. 10, the tab supports 106, 107 of the accessory unit can be seen penetrating notches 102 and 103 respectively. These tabbed supports 106, 107 function to retain the lighting unit 80 in place during use and transportation. FIG. 10 also illustrates the manner in which the arm support 110 of the support structure 93 carries the light bulb 90. This arm support 110 extends downward to rest on the flat floor surface 83. Thus, the arm support 110 provides a platform for presenting the light bulb 90 to the slanting floor 82 and the working surface 12 for illumination.

Furthermore, as shown in FIG. 10, the trough in the recessed platform 100 is used to hold batteries 111 to power the light bulb 90. As best seen in FIG. 9, the support structure 93 of the lighting accessory unit 80 has a rectangular opening 99 in its center. This opening 99 has downwardly extending contact supports 95, 96 on its short sides. These contact supports 95, 96 serve to define the ends of the battery opening 92 and to support the contacts for the battery circuit. As illustrated in FIG. 9, contact support 96 supports a spring contact 98 that closes one end of the circuit with the batteries 111. Contact support 95 supports a metal washer contact 97 that closes the circuit at the opposite end. The spring contact 98 is compressed when batteries 111 are inserted in the circuit and holds the batteries in secure contact with one another and the washer contact 99 to insure a closed circuit at all times.

As already mentioned, the support structure 93 has a rectangular opening 99 that forms the outer boundaries of the battery opening 92. Thus, when the lighting accessory unit 80 is placed in the base structure 11, the semi-cylindrical recess 105 of the recessed platform 100 completes the battery opening 92. As best seen in FIG. 10, the semi-cylindrical recess 105, includes upward extending receiving tabs 108 that receive the downward extending contact supports 95, 96 to retain the contact supports 95, 96 and thus the contacts 97, 98 in rigid contact with the batteries 111.

Referring to FIGS. 9 and 10, the simple circuit connecting the batteries 111 to the light switch 72 and the light bulb 90 is old in the art and need not be explained in detail here. A standard connecting wire is soldered to the spring contact 98 and to the light bulb ground connector 114. Another standard connecting wire is soldered to the power supply contact 115 of the light bulb 90 and to the light switch 72. Finally, a third connecting wire is soldered between the switch 72 and the washer contact 97 on contact support 95. Thus, when the batteries 111 are placed between the spring contact 98 and the washer contact 97 a complete circuit is formed. Turning the light switch 72 to the "on" position allows current to flow from the batteries 111 through this simple circuit to power the light bulb 90. The light from the bulb 90 reflects off of the sloped floor 82 and the working surface 12 is lit.

In another configuration, the drawing surface would not be lighted. The working surface 12 is constructed without the oval hole 71 and can be made of an opaque material. In addition, the lighting accessory unit 80 can be eliminated. Consequently, the drawing surface would include a base 11 and a working surface 12. An accessory unit could be included to prevent materials stored in the interior of the base structure from entering the semi-cylindrical recess 105 when the working surface is lowered and the drawing surface is held in a vertical position. The accessory unit would be similar to the light accessory unit 80 but would not include the electrical components. In this configuration, the working surface 12 could be made of a material, such as a paramagnetic material, e.g. a metal, so that magnets would adhere to the working surface 12.

Figure 11:
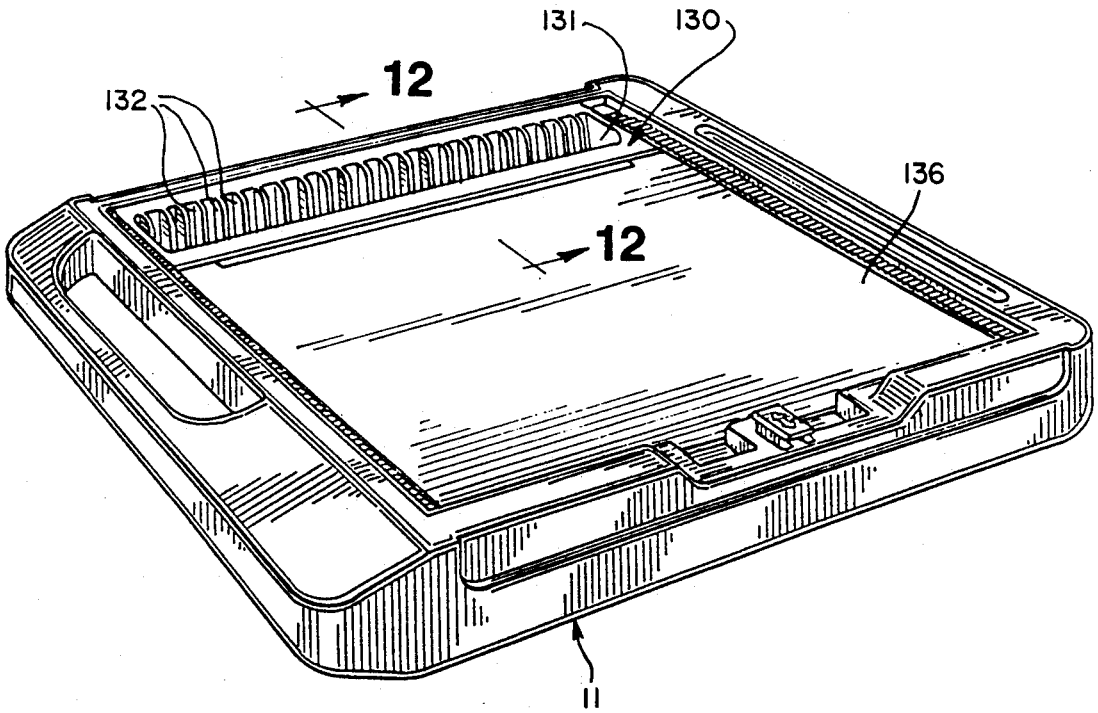
FIG. 11 is a left front perspective view of the invention assembled with a working surface and a drawing utensil accessory tray.

Another important aspect of the invention is illustrated in FIG. 11. As discussed above, the base structure 11 is made of one piece of molded plastic and can be made into a lighted drawing surface by simply adding a lighting accessory unit 80 and a working surface 12. However, the base structure 11 is not restricted to just receiving the lighting accessory unit, but instead can receive accessory units with different characteristics. Because of their different characteristics, these other accessory units can be combined with the base structure 11 to form many different drawing surfaces.

FIG. 11 illustrates a drawing surface complete with a utensil accessory tray 130. The utensil accessory tray 130 includes a recess 131 and utensil dividers 132. During use, drawing utensils can be placed standing between the dividers 132 for display. This display setting makes locating and selecting a desired utensil easy and temporarily stores the utensils in a neat and organized fashion.

Figure 12:
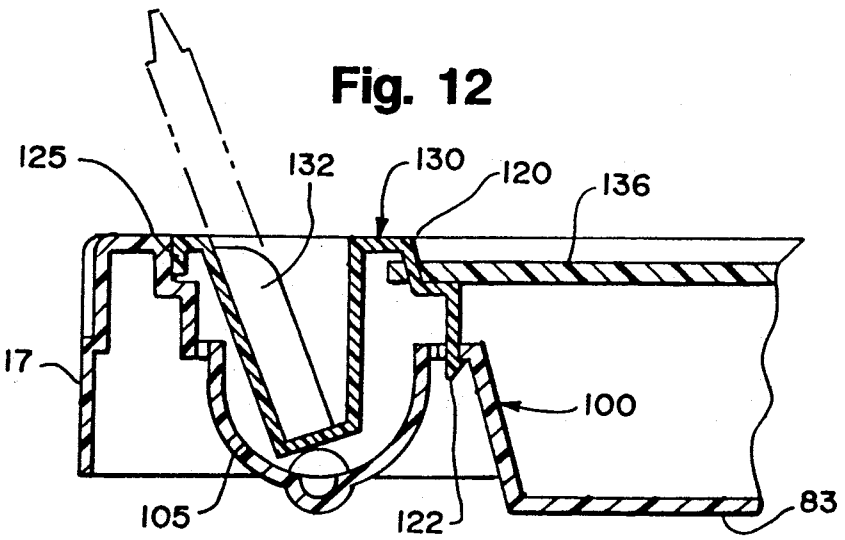
FIG. 12 is a partial cross-sectional view taken along lines 12—12 of FIG. 11 showing a utensil accessory tray positioned in the base structure.
Figure 14:
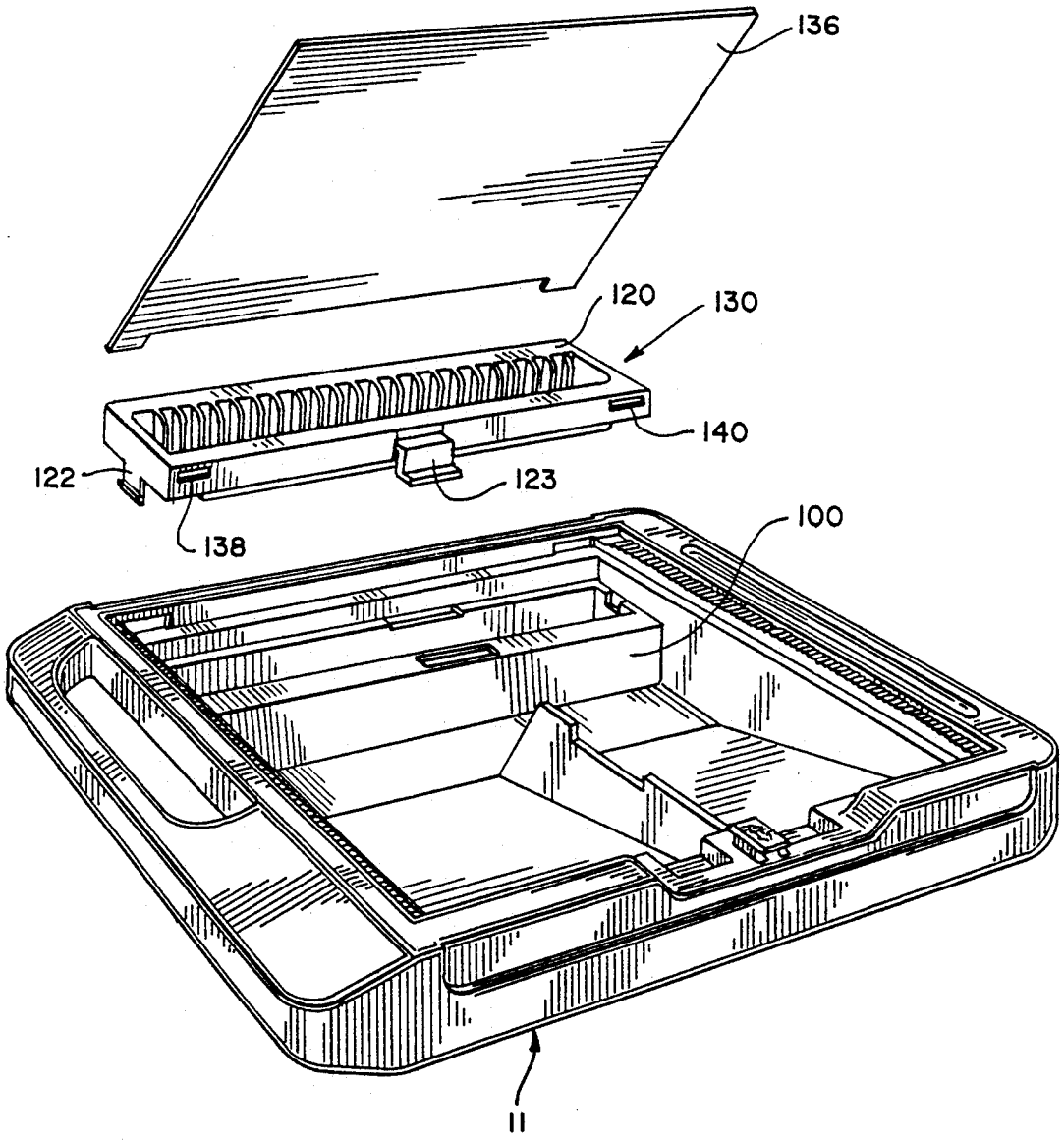
FIG. 14 is a left front perspective exploded view of the invention with a drawing utensil accessory tray.

The utensil accessory tray 130 can be seen in greater detail in FIG. 14. The accessory tray 130 is positioned on the recessed platform 100 in a manner analogous to the lighting accessory unit. Thus, it has a plastic support structure 120 and tabbed support arms 122, 123 and 124 that function to retain the accessory unit in place. As best seen in FIG. 12, the tabbed support arm 122 is received by notch 103 to retain the tray in position during use. The other two tabs 122 and 124 function in a similar fashion. However, as illustrated in FIG. 12, the back 125 of the utensil accessory tray 130 does not have a tabbed support arm but instead rests directly on the base structure. However, a tab support arm similar to tab 106 in FIG. 10 may be used with the accessory tray 130. The tray slopes backward as shown in FIG. 9 to better support drawing utensils between the utensil dividers 132.

Figure 13:
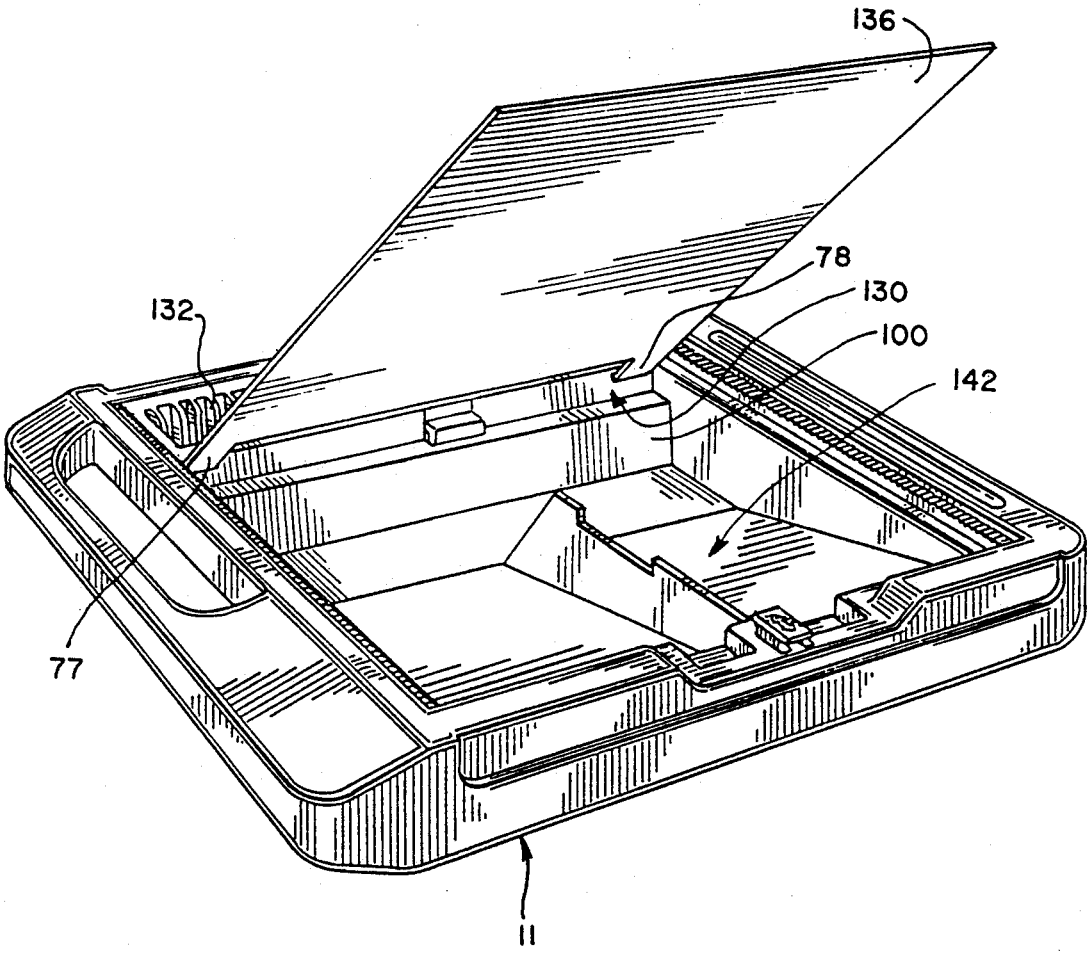
FIG. 13 is a left front perspective view of the invention assembled with a drawing utensil accessory tray and its working surface in a raised position.

FIG. 13 illustrates this embodiment of the invention with its working surface 136 in the raised position. FIG. 13 also reveals the internal construction of the invention and the compartment 142 where drawing utensils can be stored during transportation. The working surface 136 functions with the same sort of tab and slot hinge as the lighted drawing surface. However, in this embodiment, the working surfaces tabs are received by slots 138, 140 in the utensil accessory tray illustrated in FIG. 14. Thus, the working surface 136 in this embodiment of the invention is smaller than the working surface of the lighted drawing surface.

In addition, the drawing surface can be constructed with various characteristics. As already mentioned, the working surface 136 could be made of plastic. However, the working surface 136 could also be made of a material, such as metal, so that magnets would adhere to the working surface 136. Alternatively, the working surface 136 could be made of plastic with metal particles or a metal layer affixed to a plastic layer to achieve the same magnetic effect. Also, the working surface 136 could be constructed with a textured surface or coated with a layer of material so that it functions as a chalk board.

From the foregoing it will be seen that new and improved drawing surfaces that can be constructed from the same adaptable underlying base structure have been brought to the art. This adaptable base structure allows the low cost manufacture of portable drawing surfaces of various types and characteristics. It decreases costs by obviating the need for tooling molds for separate base structures for each drawing surface type and by obviating the need for separate manufacturing lines for making separate base structures. Thus, the invention prevents the wasteful duplication of machinery and operating personnel for making separate base structures. Accordingly, the present invention enables the economical manufacture of portable drawing surfaces of varying characteristics. In particular, it allows the economical production of portable drawing surfaces with either a backlit working surface or an accessory tray for storing drawing utensils.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and the scope of the invention.

We claim:

1. A portable drawing surface for drawing or tracing comprising:
   - a base structure;
   - an accessory unit removably connected to said base structure; and
   - a working surface connected to said base structure or said accessory unit whereby said working surface is removable by lifting and pulling away from said base structure or said accessory unit.

2. The invention as defined in claim 1 wherein said base structure accommodates different accessory units and different working surfaces to form portable drawing surfaces with different characteristics.

3. The invention as defined in claim 1 further comprising:
   - a hinge to connecting said working surface to said base structure or said accessory unit.

4. The invention as defined in claim 3 wherein said base structure includes
   - a floor having two sections, a front section and a rear section, said front section being downwardly sloped toward the rear section and said rear section being relatively flat.

5. The invention as defined in claim 4 wherein said front section of said floor includes a vertically extending wall for supporting said working surface.

6. The invention as defined in claim 1 further comprising a handle.

7. The invention as defined in claim 1 wherein said seat includes notches for receiving tabbed support structures from said accessory unit.

8. The invention as defined in claim 3 wherein said hinge is a tab and slot hinge.

9. The invention as defined in claim 3 wherein said base structure includes a locking assembly for retaining said working surface to said base structure.

10. The invention as defined in claim 9 wherein said locking assembly comprises:
   - a locking assembly button having tabbed support legs; and
   - paired slots for receiving said support legs in said base structure;
   - wherein said locking assembly button is slidably connected to said paired slots in said base structure.

11. The invention as defined in claim 10 wherein said base structure includes recesses on either side of said paired slots for lifting said working surface.

12. The invention as defined in claim 1 wherein said accessory unit is a light assembly.

13. The invention as defined in claim 1 wherein said accessory unit is a utensil tray.

14. The invention as defined in claim 1 wherein said working surface is translucent.

15. The invention as defined in claim 1 wherein said working surface includes a trough for holding utensils.

16. A portable lighted drawing surface for drawing or tracing comprising:
   - a base structure including a platform;
   - a working surface connected to said base structure; and
   - a lighting accessory unit including a light supported by and removably connected to said lighting accessory unit and said lighting accessory unit connected to said platform of said base structure for lighting said working surface.

17. The invention as defined in claim 16 wherein said working surface is translucent.

18. The invention as defined in claim 16 wherein said working surface includes a trough for holding utensils.

19. The invention as defined in claim 16 wherein said portable lighted drawing surface further comprises a hinge to connect said working surface to said base structure.

20. The invention as defined in claim 19 wherein said hinge is a tab and slot hinge.

21. The invention as defined in claim 16 wherein said lighting accessory unit comprises:
   - a support structure;
   - a light switch supported by said support structure;
   - a light bulb supported by said support structure.
   - a battery compartment including electrical contacts; and
   - a circuit wherein said light switch, said light bulb and said contacts of said battery compartment are connected in series.

22. The invention as defined in claim 21 wherein said lighting accessory unit includes tabbed support arms that mateably connect with notches in said base structure.

23. The invention as defined in claim 21 wherein said lighting accessory unit includes an opening that forms said battery compartment with said base structure forming the bottom of said battery compartment.

24. The invention as defined in claim 21 wherein said lighting accessory unit includes a support arm that extends downward thereby forming a platform for said light bulb.

25. The invention as defined in claim 16 wherein said base structure includes a sloped floor that reflects light upwards from said lighting accessory unit and thereby lights said working surface.

26. The invention as defined in claim 16 wherein said base structure includes a locking assembly for retaining said working surface to said base structure.

27. The invention as defined in claim 26 wherein said locking assembly comprises:

a locking assembly button having tabbed support legs; and paired slots for receiving said tabbed support legs in said base structure;

wherein said locking assembly button is slidably connected to said paired slots in said base structure.

28. The invention as defined in claim 21 wherein said working surface includes an aperture to accept said light switch.

29. A portable drawing surface for drawing or tracing comprising:

a base structure;

a utensil accessory tray connected to said base structure for organizing drawing utensils;

a working surface;

and a tab and slot hinge to connect said working surface to said accessory tray or said base structure.

30. The invention as defined in claim 29 wherein said base structure includes a locking assembly for retaining said working surface fixably connected to said base structure.

31. The invention as defined in claim 30 wherein said locking assembly comprises:

a locking assembly button having tabbed support legs; and paired slots for receiving said tabbed support legs in said base structure;

wherein said locking assembly button is slidably connected to said paired slots in said base structure.

32. The invention as defined in claim 29 wherein said utensil accessory tray comprises:

a recess for holding a utensil.

33. The invention as defined in claim 29 wherein said utensil accessory tray includes tabbed support arms which mateably connect with notches in said base structure.

34. The invention as defined in claim 29 wherein said working surface includes a trough for holding utensils.

35. The invention as in claim 29 wherein said working surface is made of a material so that a magnet adheres to the working surface.

36. The invention as in claim 1 wherein said working surface is made of a material so that a magnet adheres to the working surface.

37. The invention as defined in claim 16 wherein said platform includes a recess.

38. The invention as defined in claim 16 wherein said platform is positioned lower than said working surface.

39. The invention as defined in claim 1 wherein said base structure includes a platform and said accessory unit is connected to said platform.

40. The invention as defined in claim 29 wherein said base structure includes a platform and said accessory tray is connected to said platform.

* * * * *

UNITED STATES PATENT AND TRADEMARK OFFICE

CERTIFICATE OF CORRECTION

PATENT NO. : 5,284,445

DATED : February 8, 1994

INVENTOR(S) : Charles W. Dietterich et al

It is certified that error appears in the above-indentified patent and that said Letters Patent is hereby corrected as shown below:

On the title page, under Other Publications, second line, after "left" insert -- -D19/88 --.

Column 7, line 61, "connecting" should read --connect--

Signed and Sealed this

Second Day of August, 1994

*Attest:*

*Attesting Officer*

BRUCE LEHMAN

*Commissioner of Patents and Trademarks*